United States Patent [19]

Lane et al.

[11] Patent Number: 4,930,573

[45] Date of Patent: Jun. 5, 1990

[54] DUAL HYDRAULIC SET PACKER

[75] Inventors: Andrew R. Lane, Plano; Richard M. Sproul, Grapevine, both of Tex.

[73] Assignee: Otis Engineering Corporation, Carrollton, Tex.

[21] Appl. No.: 334,720

[22] Filed: Apr. 6, 1989

[51] Int. Cl.[5] ..... E21B 23/06; E21B 33/122

[52] U.S. Cl. ..... 166/120; 166/189; 166/313

[58] Field of Search ..... 166/120, 121, 134, 182, 166/189, 191, 195, 212, 313, 387

[56] References Cited

U.S. PATENT DOCUMENTS

| | | | |
|---|---|---|---|
| 3,167,127 | 1/1965 | Sizer | 166/120 |
| 3,381,752 | 5/1968 | Elliston | 166/120 |
| 3,414,058 | 12/1968 | DeRochamont | 166/120 |
| 3,467,184 | 9/1969 | Young | 166/129 |
| 3,658,127 | 4/1972 | Cockran et al. | 166/120 |
| 4,216,827 | 8/1980 | Crowe | 166/120 |
| 4,413,677 | 11/1983 | Perkins | 166/55.1 |
| 4,657,084 | 4/1987 | Evans | 166/120 |
| 4,745,971 | 5/1988 | Akkerman | 166/120 |
| 4,754,812 | 7/1988 | Gentry | 166/313 |
| 4,834,175 | 5/1989 | Ross et al. | 166/120 |

*Primary Examiner*—George A. Suchfield

*Assistant Examiner*—Terry Lee Melius

*Attorney, Agent, or Firm*—Dennis T. Griggs

[57] ABSTRACT

A dual string packer for releasable, hydraulic setting within a wall casing is disclosed. The packing seal elements and hydraulic actuator assembly are mounted for sliding movement along primary and secondary packer mandrels. Setting forces are applied to the packing seal elements by a setting cylinder which is mounted for slideable, sealing engagement against the primary and secondary packer mandrels, and setting forces are applied to the anchor slips by a piston which is sealed against the primary and secondary packer mandrels. The set condition is maintained by a pair of locking rods and segmented ratchet slips. The locking rods are carried by the setting cylinder head and are retracted axially out of piston pockets as a variable volume pressure chamber is pressurized. Upon achieving set engagement of the anchor slips and seal elements, the locking rods are trapped in compression between the head of the setting cylinder and the segmented ratchet slips. The locking rods are compressed by the reaction forces imposed by the expandable seal elements through the head of the setting cylinder, and by the retraction forces transmitted through the anchor slips and piston.

13 Claims, 7 Drawing Sheets

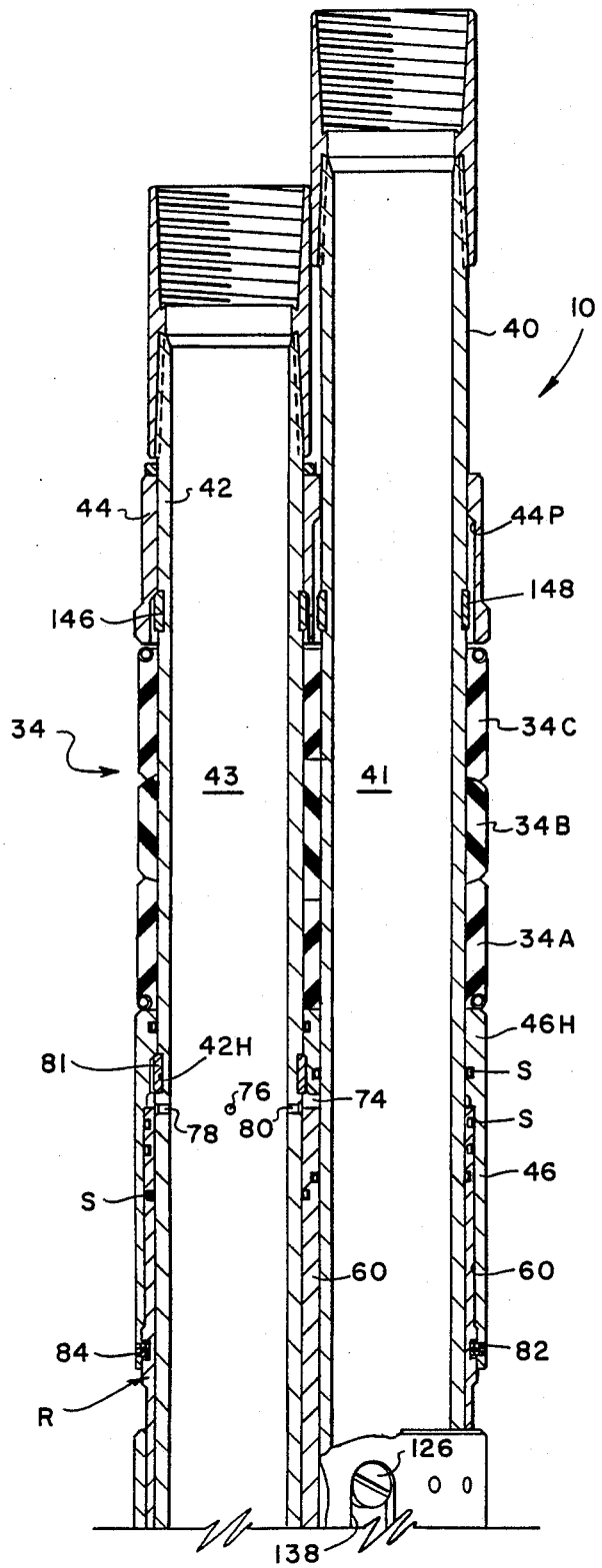
FIG. 3A RUN
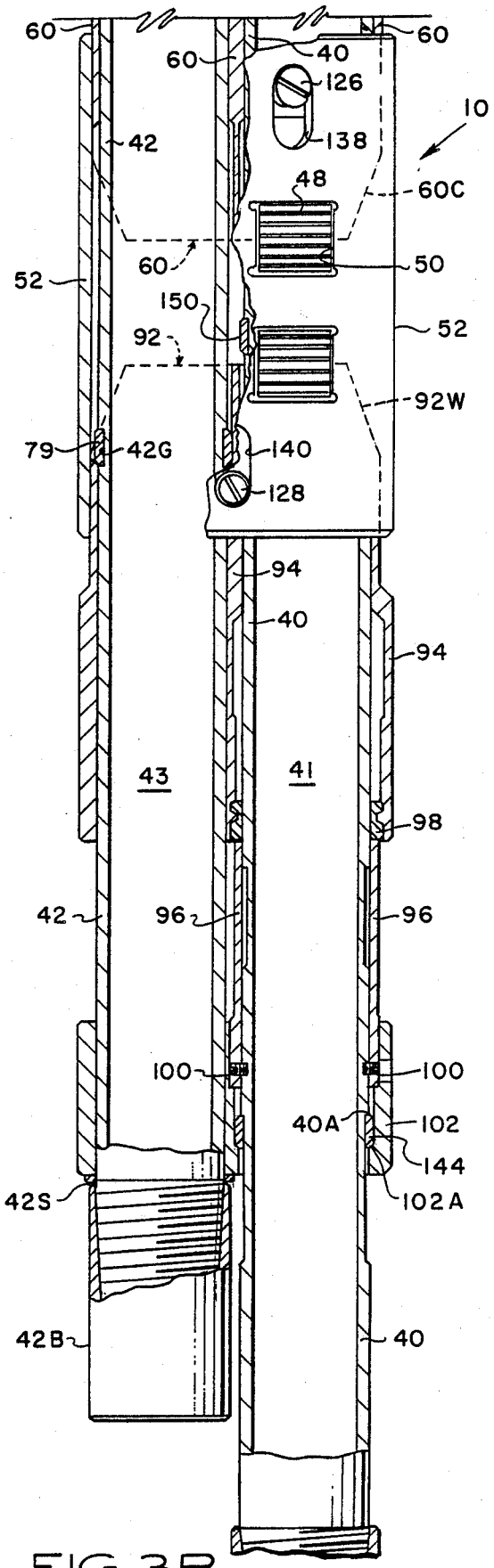
FIG. 3B

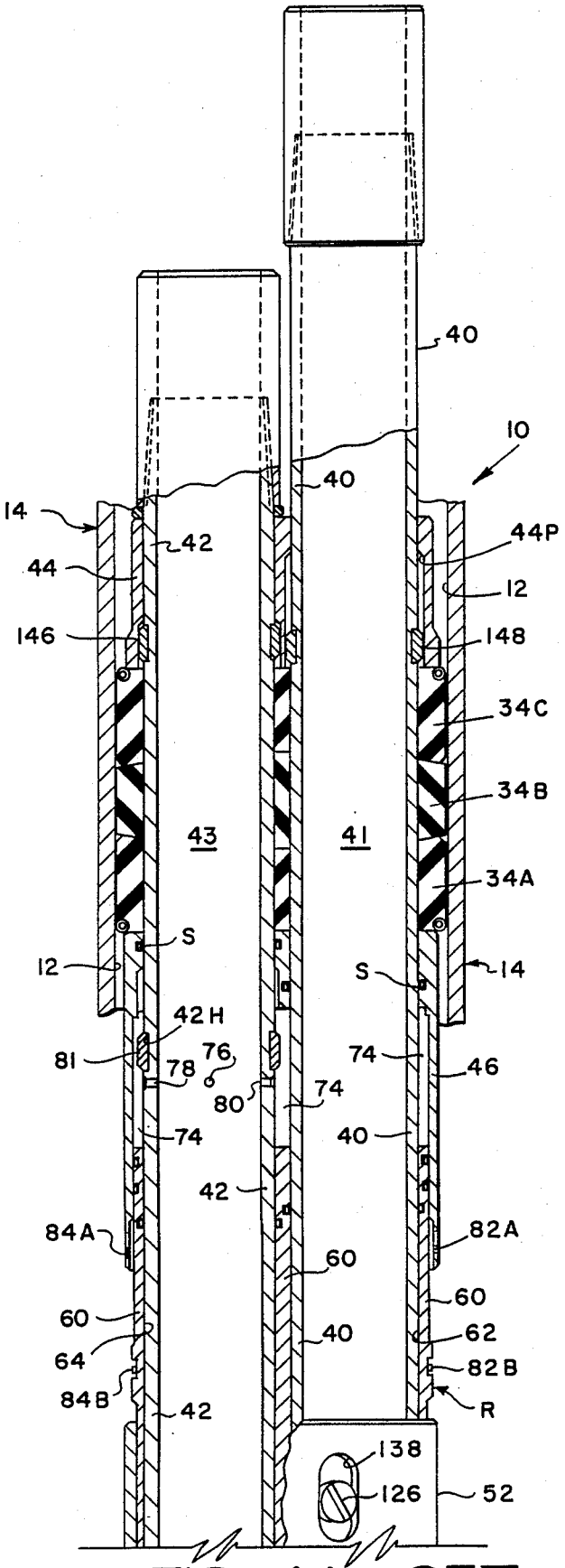
FIG. 4A SET
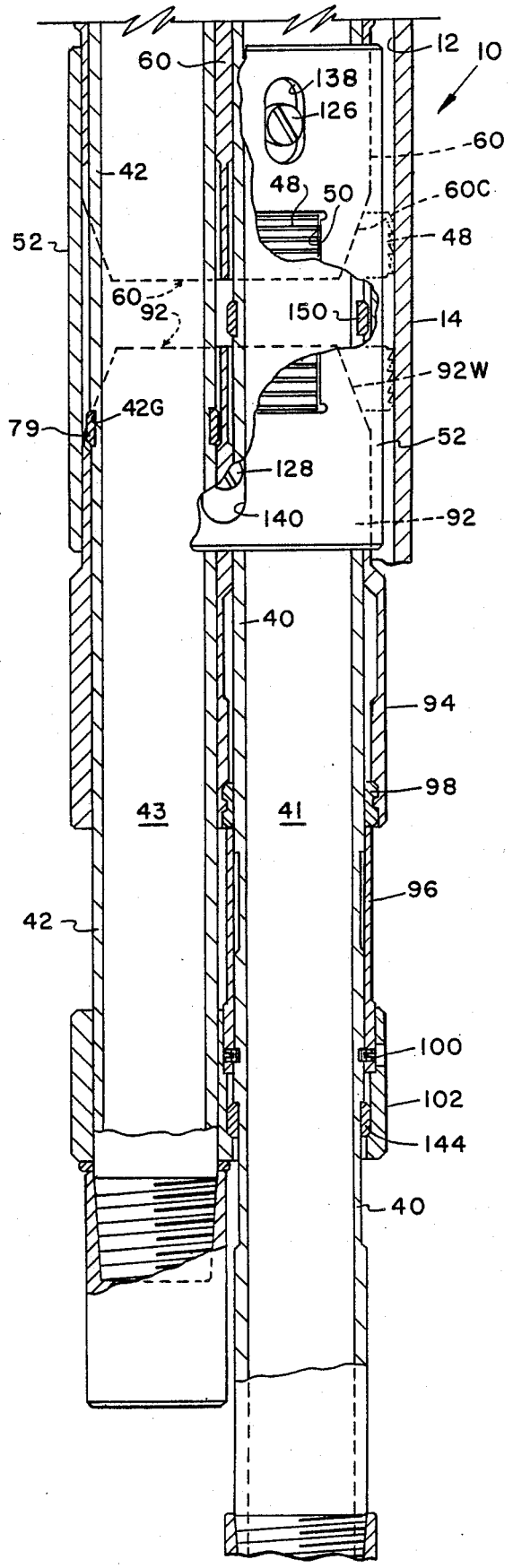
FIG. 4B

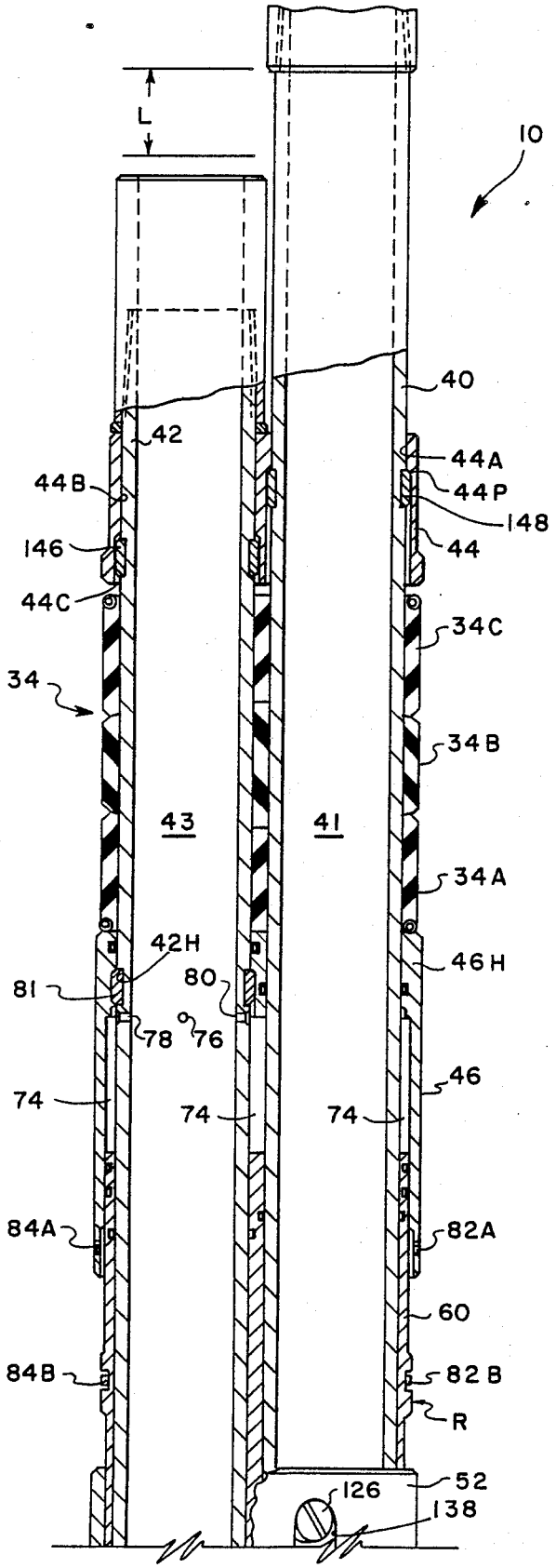
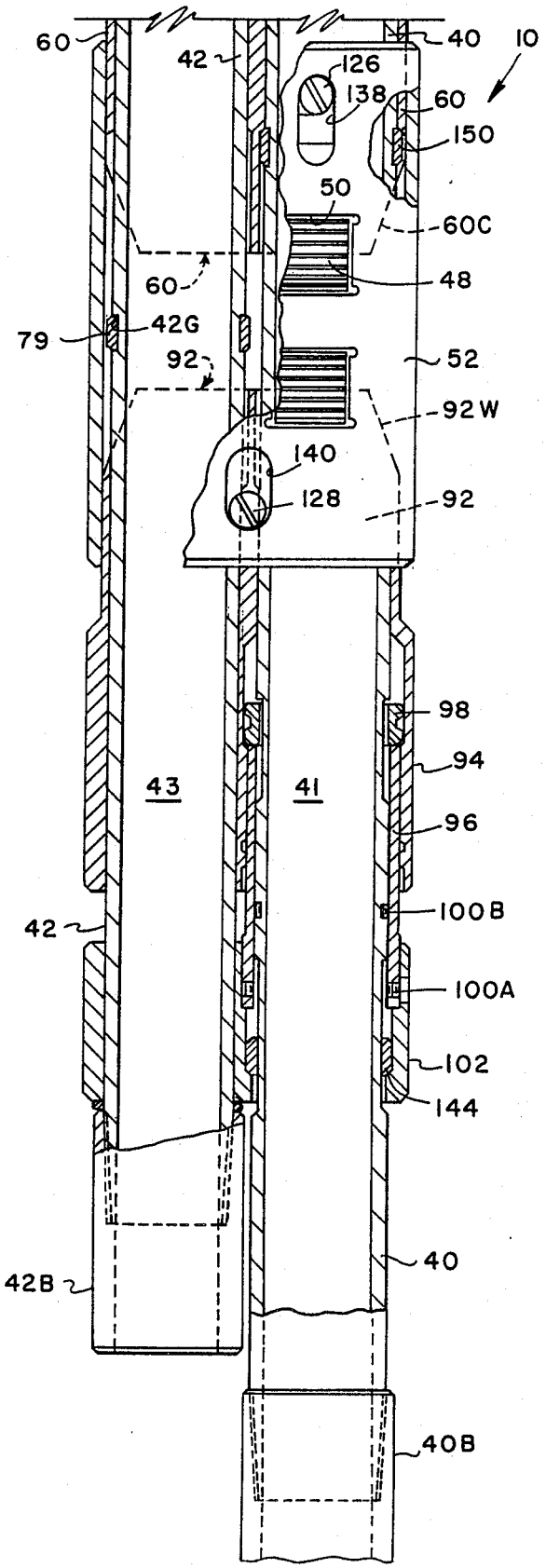
FIG. 5A RELEASE FIG. 5B

FIG. 11 RUN

DUAL HYDRAULIC SET PACKER

FIELD OF THE INVENTION

This invention relates generally to petroleum production equipment, and in particular to a dual bore, hydraulic actuated retrievable well packer for securely sealing the annulus between dual production tubing strings and the bore of a surrounding well casing.

BACKGROUND OF THE INVENTION

In the course of treating and preparing subterranean oil and gas wells for production, a well packer along with production equipment are run into the well on a tubing string, with the packer being set against a casing bore. Well packers have been designed to accommodate one, two or more production tubing strings. Examples of prior dual string well packers are shown in U.S. Pat. No. 4,413,677 to Perkins; U.S. Pat. No. 3,167,127 to Sizer; U.S. Pat. No. 3,391,741 to Elliston; and, U.S. Pat. No. 3,381,752 to Elliston. These patents are incorporated herein by reference for all purposes.

The purpose of a dual zone packer is to seal the annulus between the outside of both production tubing strings and the inside of the well casing to prevent movement of fluids through the annulus past that location. The packer is provided with slip anchor members having opposed camming surfaces which cooperate with complementary opposed wedging surfaces, whereby the slip anchor members are extendable radially into gripping engagement against the well casing bore in response to relative axial movement of the wedging surfaces. The packer also carries annular resilient seal elements which expand radially into sealing engagement against the bore of the well casing in response to axial compression forces. Longitudinal movement of the packer components which set the anchor slips and the sealing elements may be effected either hydraulically or mechanically. During run-in, the packer is mechanically locked in the unset condition by shear pins.

In a dual production zone well, a lower permanent packer with an expendable sealing plug may be set by an electric wire line for isolation of the lower zone after perforating and while working on the upper zone. After perforating the upper zone, the upper production packer is installed. With the use of a dual string hydraulic packer and a pressure-operated circulating sleeve, the completion equipment and the wellhead may be installed before displacing drilling fluid and setting the dual bore packer. Each zone is separately produced through an independent tubing string connected to the dual bore production packer. According to this arrangement, oil or gas from the upper production zone is produced through one of the production tubing strings, and oil or gas from the lower zone is produced through the other tubing string.

DESCRIPTION OF THE PRIOR ART

Conventional dual string packers include a pair of tubular mandrels on which a packing seal element is mounted and on which a anchor slip assembly is carried. The dual bore packer is prepared for setting by closing one of the mandrels, for example with a drop ball plug or pressure-responsive circulation plug. The packing seal elements and anchor slips are extended by a hydraulic actuator in response to hydraulic pressurization of the closed mandrel. Setting forces are applied to the annular seal elements and the anchor slips by a setting cylinder which is mounted for slideable sealing engagement against the packer mandrel, and by a piston which is sealed against the packer mandrel and against the bore of the setting cylinder.

The hydraulic force applied against the piston is transmitted to the anchor slips through a tubular wedge which is attached to the piston. The tubular wedge has a camming surface which is driven into engagement with ramped surfaces of the anchor slips. In one prior art dual bore packer arrangement, ratchet slips are mounted onto the tubular packer mandrels to secure the anchor slips in extended, set engagement against the casing well bore.

In the foregoing arrangement, the packer mandrels are subject to collapse as the hydraulic pressure is increased and more setting force is applied to the piston. This causes the ratchet slips to lock tighter, and the radial component of the locking force may pinch or collapse the tubular mandrels. Collapse is even more likely to occur for dual bore hydraulic packers having thin walled mandrels which provide increased diameter production bore. For such packers in which external ratchet slips engage the dual mandrels, the mandrel wall thickness must be increased and/or the hydraulic setting pressure must be limited to avoid collapse or other failure.

One prior art arrangement which attempts to avoid the collapsing mandrel problem is shown in U.S. Pat. No. 4,754,812. In that dual bore packer design, fluid pressure is applied to drive a hydraulic housing and a lower cone to set anchor slips into engagement with a well casing bore. The set position is secured by a pair of locking rods which are trapped in tension by a unidirectional ratcheting connection. In that arrangement, a pair of small diameter hydraulic piston cups are received within separate cylindrical pressure chambers and engage the lower cone for driving an annular wedge upwardly against anchor slips in response to the application of hydraulic pressure. At the same time, an upper housing receptable is pulled downwardly by the mandrels as the lower hydraulic housing is driven downwardly in response to pressurization of the piston chambers.

The locking rods slip within the tubular piston cups, and their ratchet surfaces bite against the inside bore of the hollow pistons and against the lower cone, thereby preventing retraction after the expandable seal elements have been expanded and the anchor slips have been set. By this arrangement, the reaction forces transmitted through the anchor slips onto the lower cone induce tension within the locking rods and within the packer mandrels. Accordingly, the locking rods and the mandrels are trapped in tension during the time that the packer is set, which may be for a period of two years or more.

A limitation on the foregoing design is that the locking rods and the mandrels, when constantly subjected to tension loading, are more likely to fail downhole because of the combined effects of corrosion (e.g., in $H_2S$ formations) and stress. Moreover, it is difficult to obtain a reliable seal about the locking rods which are extended longitudinally through the expandable seal elements in addition to sealing the primary and secondary mandrels.

Another limitation on the foregoing arrangement is that the effective cylinder piston area is limited by the size of the small diameter piston cups, so that a relatively large hydraulic pressure, for example as much as 4,000 psi, must be applied to the tubing string to initiate the setting action, and as much as 5,000 psi may be required to complete the setting operation. Such high hydraulic pressure levels may damage thin walled tubing and pressure seals.

OBJECTS OF THE INVENTION

Accordingly, it is the principal object of the present invention to provide an improved dual string packer which can be hydraulically set and locked in sealing engagement against a well bore without requiring the application of a continuous tension setting force on the packer mandrels to maintain the set condition.

A related object of the invention is to provide an improved dual string hydraulic packer which can be set and locked in sealing engagement against a well bore, without subjecting the primary and secondary packer mandrels to radially directed compression setting forces which could pinch or collapse the mandrels.

Another object of the invention is to provide an improved dual string hydraulic packer which can be set and locked in sealing engagement against a well bore, wherein the locking elements which maintain the set condition are trapped in axial compression, and not in tension.

Another object of the invention is to increase the effective piston area and setting cylinder area in a dual string hydraulic set packer.

A related object of the invention is to reduce the hydraulic pressure level required to achieve positive set and sealing engagement against a well bore by a dual string hydraulic packer.

Another object of this invention is to provide an improved hydraulic setting actuator which can be used in combination with relatively large bore, thin walled packer mandrels, and which can be safely set and sealed against a well bore without damaging the packer mandrels.

Yet another object of the invention is to provide an improved dual string hydraulic packer which utilizes one piece primary and secondary packer mandrels, which cooperate with a hydraulic actuator for achieving a positive set of anchor slips and positive seal of seal elements against a well casing, with the hydraulic actuator being locked in the set position without imposing tension or compression loading on the primary and secondary mandrels.

A related object of the invention is to provide an improved dual string hydraulic packer having primary and secondary mandrels and a hydraulic actuator which can be set and locked in the set condition without applying ratchet slips against either one of the primary and secondary mandrels.

Another object of the invention is to minimize the number of components which are extended through the packing seal elements.

Another object of the invention is to provide an improved dual string hydraulic packer in which the hydraulic setting force is applied equally on the hydraulic actuating piston and the setting cylinder to set the annular seal elements and the anchor slips.

SUMMARY OF THE INVENTION

The foregoing objects are achieved according to a preferred embodiment of the present invention in which a dual string hydraulic packer has a hydraulic actuator assembly mounted between packing seal elements and anchor slips. In the preferred embodiment, the packing seal elements and hydraulic actuator assembly are mounted for sliding movement along primary and secondary packer mandrels. Equal setting forces are applied to the packing seal elements and the anchor slips by a setting cylinder which is mounted for slideable sealing engagement against the primary and secondary packer mandrels, and by a piston which is sealed against the primary and secondary packer mandrels and against the inside diameter bore of the setting cylinder, respectively. A tubular wedge portion of the piston engages the anchor slips, and the packing seal elements are engaged by the head of the setting cylinder.

One of the packer mandrels is plugged, and hydraulic fluid is pumped into the closed mandrel and is ported into a variable volume pressure chamber defined between the head of the piston and the head of the setting cylinder. The setting cylinder and the piston are initially locked together by shear screws. Upon application of hydraulic pressure into the variable volume pressure chamber, the pressure forces are increased until the shear strength of the shear screws is overcome. As the shear screws separate, the setting cylinder is released and extends against the packing seal elements, while the piston drives the top wedge into engagement with the anchor slips.

According to the preferred embodiment of the invention, the set condition is maintained and retraction of the piston relative to the setting cylinder is prevented by a pair of locking rods and segmented ratchet slips. In this arrangement, the piston head has a pair of cylindrical pockets in which the locking rods are received. The locking rods are mechanically fastened to the underside of the setting cylinder head by a threaded bolt fastener. The segmented ratchet slips are received within counterbore pockets and permit extension while preventing retraction of the locking rods relative to the piston. The locking rods are carried by the setting cylinder head and are retracted axially out of the piston pockets as the variable volume pressure chamber is pressurized. Upon achieving set engagement of the anchor slips and seal elements, the locking rods are trapped in compression between the head of the setting cylinder and the segmented ratchet slips. The locking rods are compressed by the reaction forces imposed by the expandable seal elements through the head of the setting cylinder, and by the reaction forces transmitted through the anchor slips and piston.

Because the piston and setting cylinder are mounted for slideable, sealing engagement along the primary and secondary mandrels, and because the locking rods are secured by ratchet slips within pockets formed in the piston head, the primary and secondary mandrels are not subjected to radially directed setting forces which might cause collapse of the packer mandrels. Because the packer mandrels are not loaded radially, the primary and secondary mandrels can be provided with relatively large bores and relatively thin sidewalls. Moreover, because the set condition is locked internally by the locking rods, auxiliary mandrels are not required, and the packing seal elements are required to seal only the primary and secondary mandrels.

Since the locking action is achieved internally within the piston head, the primary and secondary mandrels are not subjected to continuous tension loading after setting is completed which might cause premature failure of the mandrels. Because of the internal locking arrangement and the location of the hydraulic actuator piston and setting cylinder components intermediate the seal elements and the anchor slips, substantially the entire piston head area and setting cylinder head area are available for transmitting the setting force developed within the variable volume hydraulic pressure chamber.

The novel features of the invention are set forth with particularity in the claims. The invention will best be understood from the following description when read with reference to the accompanying drawings.

BRIEF DESCRIPTION OF THE DRAWINGS

FIGS. 3A and 3B taken together form a longitudinal view in half section of the dual string hydraulic set packer of the present invention shown in a configuration to be run in a tubular well casing;

FIGS. 4A and 4B taken together form a longitudinal view in half section of the dual string hydraulic set packer of the present invention showing the various parts of the packer in relative positions after the sealing elements and anchor slips have been expanded and extended in the set position, respectively;

FIGS. 5A and 5B taken together form a longitudinal view in half section of the dual string packer assembly of the present invention showing the various parts of the packer in relative positions after the sealing elements and anchor slips have been retracted in preparation for retrieval of the packer from the bore of a well casing;

DETAILED DESCRIPTION OF THE PREFERRED EMBODIMENT

Figure 1:
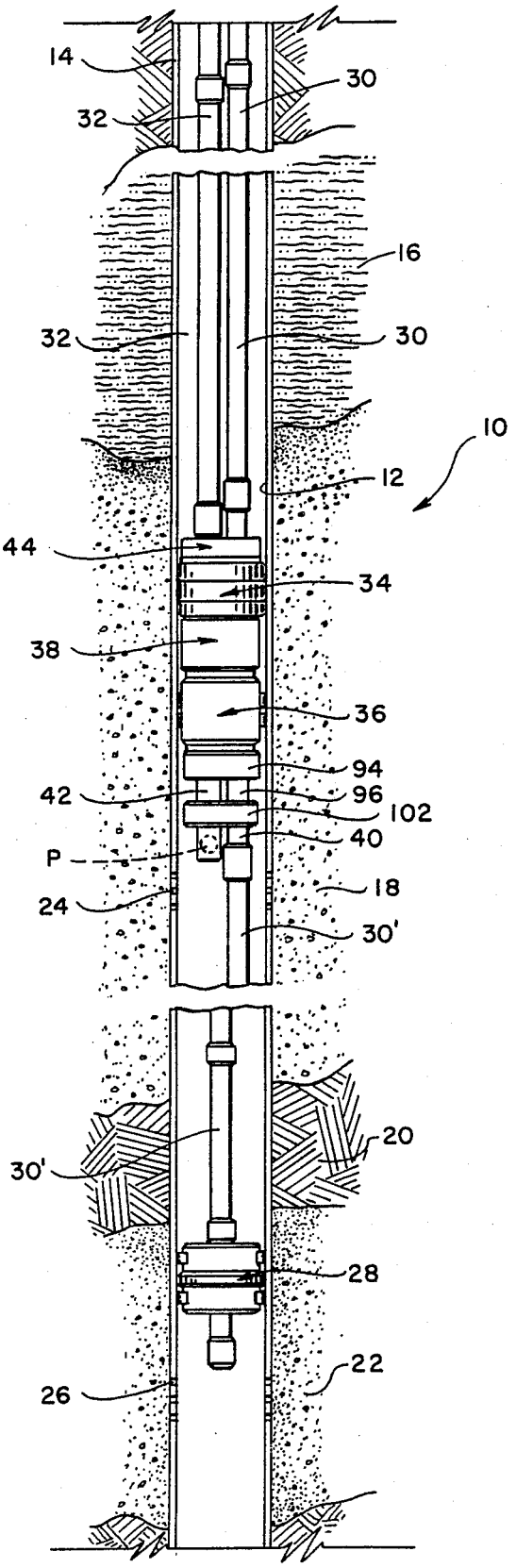
FIG. 1 is a simplified schematic diagram showing a production well intersecting two hydrocarbon producing formations, with the lower producing formation being isolated by a single string bottom packer, and with the upper formation being isolated by a dual hydraulic production packer.

In the description which follows, like parts are marked throughout the specification and drawings with the same reference numerals, respectively. The drawings are not necessarily to scale and the proportions of certain parts have been exaggerated to better illustrate details and features of the invention. As used herein, the designation "S" refers to internal and external O-ring seals and the designation "T" refers to a threaded union.

Apparatus constructed according to the present invention in the form of a dual string hydraulic well packer 10 is shown in releasably set, sealed engagement against the bore 12 of a tubular well casing 14. The tubular casing string 14 extends through multiple layers of overburden 16, traversing a first hydrocarbon formation 18, intersects one or more layers of underburden 20 and then intersects a second hydrocarbon formation 22. The tubular casing sections which intersect the hydrocarbon formations 18 and 22 are perforated by multiple openings 24, 26, respectively, formed through the casing sidewall to permit entry of formation fluids from the producing formations 18, 22, respectively.

The well is sealed by a bottom packer 28 with an expendable sealing plug in place, which is set by electric wire line for isolation of the lower producing zone 22 after perforating and while working on the upper producing zone 18. After perforating the upper producing zone 18, the dual hydraulic packer 10 is installed. The expendable sealing plug in the bottom packer 28 is pushed out as a primary production string 30 is landed.

Each production zone 18, 22 is separately produced through an independent, primary tubing string 30 and a secondary tubing string 32. The dual production tubing strings 30, 32 are extended to a surface wellhead assembly (not illustrated).

Figure 2:
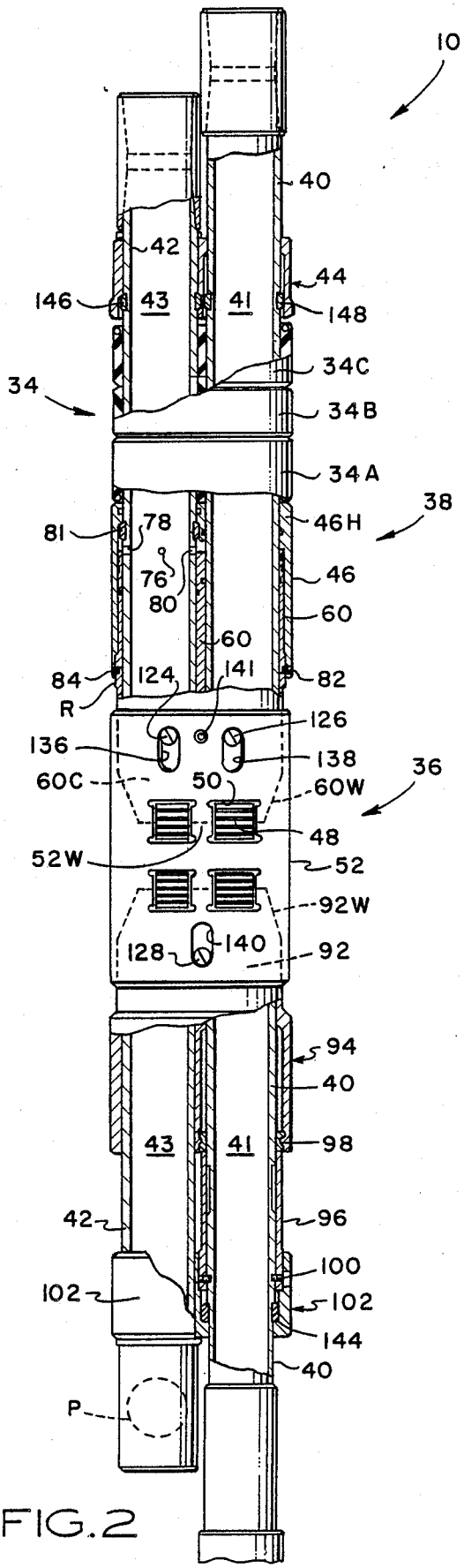
FIG. 2 is an elevation view, partly in section, of the dual string production shown in FIG. 1.

Referring now to FIGS. 1 and 2, the dual string hydraulic packer 10 includes an expandable seal assembly 34 and a slip anchoring assembly 36, both radially extendable as described hereinafter to engage the bore 12 of the surrounding well casing 14. Additionally, the dual string packer 10 includes a hydraulic actuator assembly 38 (FIG. 11) slideably mounted in sealing engagement onto a primary packer mandrel 40 and a secondary packer mandrel 42. The dual production tubing strings 30, 32 are connected to the primary and secondary packer body mandrels 40, 42, respectively. The primary and secondary packer body mandrels 40, 42 have longitudinal flow passages 41, 43, respectively, connected in flow communication with the dual production tubing strings 30, 32. The hydraulic actuator assembly 38 is disposed between the annular seal assembly 34 and the slip anchor assembly 36.

Figure 12:
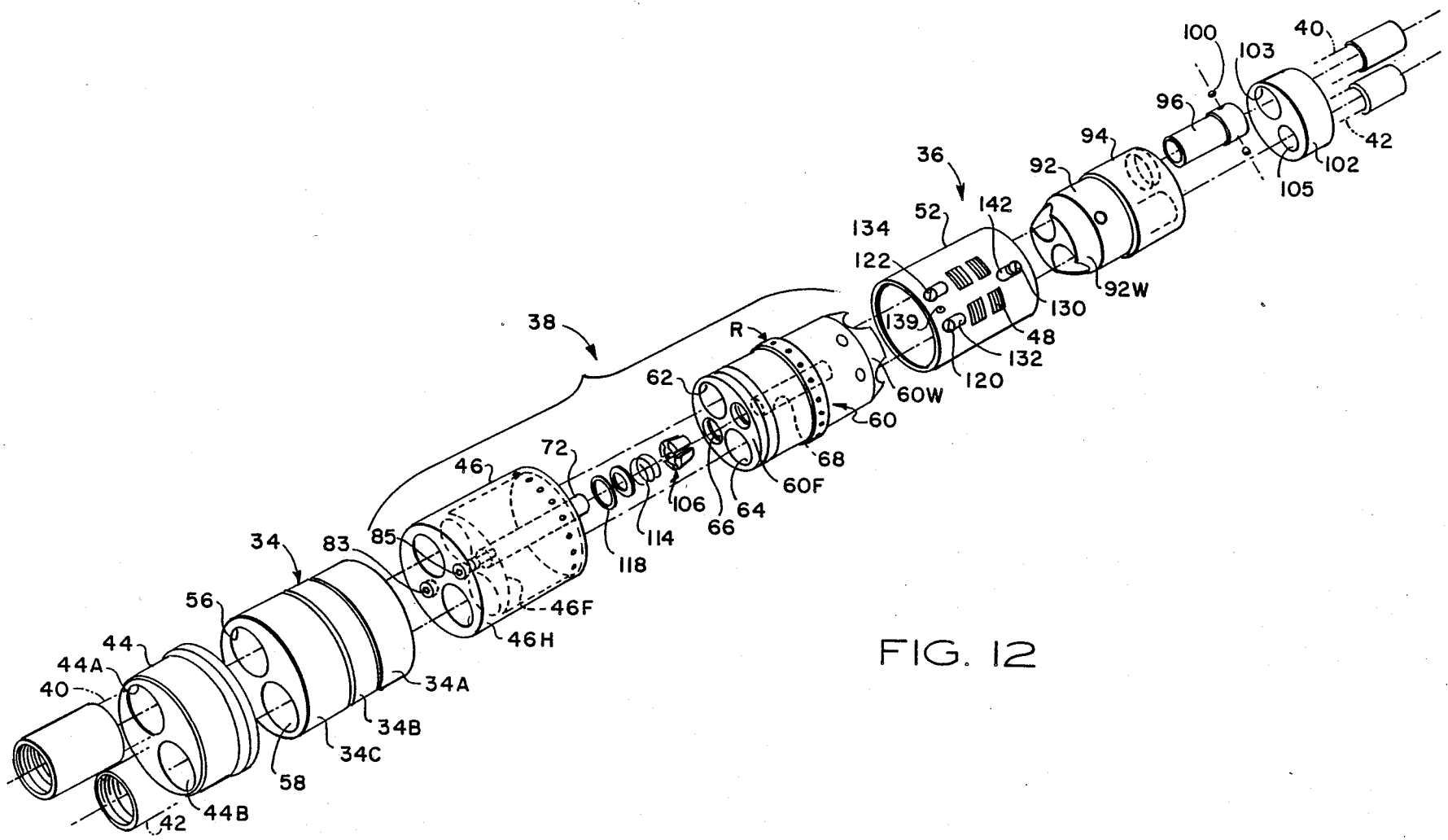

Referring now to FIGS. 2 and 12, the seal assembly 34 is mounted directly onto the external surface of the primary and secondary packer mandrels 40, 42. The expandable seal assembly 34 comprises a lower end packing element 34A, a center packing element 34B and an upper packing element 34C. The packing elements 34A, 34B, 34C are preferably made of a resilient polymeric material and are stacked in concentric alignment about a longitudinal axis between an upper element retainer 44 and the head 46H of a setting cylinder 46. The shape, number and method of mounting the seal elements included in seal assembly 34 may be varied as known in the art while still providing a seal assembly that may be expanded radially to selectively engage a well bore surrounding the packer 10.

Referring now to FIG. 2, FIG. 10, FIG. 11 and FIG. 12, the slip anchor assembly 36 includes a plurality of anchor slips 48 which are mounted for radial movement through rectangular windows 50 formed in a tubular slip carrier 52. While the number of anchor slips 48 may be varied, the tubular slip carrier 52 is provided with an appropriate corresponding number of windows 50, with four anchor slips 48 being preferred. Each of the anchor slips 48 includes lower and upper gripping surfaces 48A, 48B, respectively, positioned to extend radially through the windows 50 with the wall area 52W of the slip carrier 52 between the paired rectangular windows 50 confining a coil spring 54 which resides in a pocket 48P of the anchor slip 48.

The coil spring 54 biases the anchor slip 48 radially inwardly relative to the wall 52W of the slip carrier 52, thereby maintaining the gripping surfaces 48A, 48B retracted in the absence of setting forces displacing the anchor slips radially outwardly. Each of the gripping surfaces 48A, 48B has horizontally oriented gripping edges which provide gripping engagement in each direction of longitudinal movement of the packer 10. The gripping edges are radially curved to conform with the cylindrical internal surface of the well casing bore 12 against which the anchor slips 48 are set.

Referring again to FIG. 12, the expandable seal elements 34A, 34B, 34C have first and second cylindrical bores 56, 58 in which the primary and secondary mandrels 40, 42 are received in slideable, sealing engagement therewith. Likewise, the seal element retainer 44 has first and second cylindrical bores 44A, 44B through which the primary and secondary mandrels 40, 42 are extended, respectively.

Figure 11:
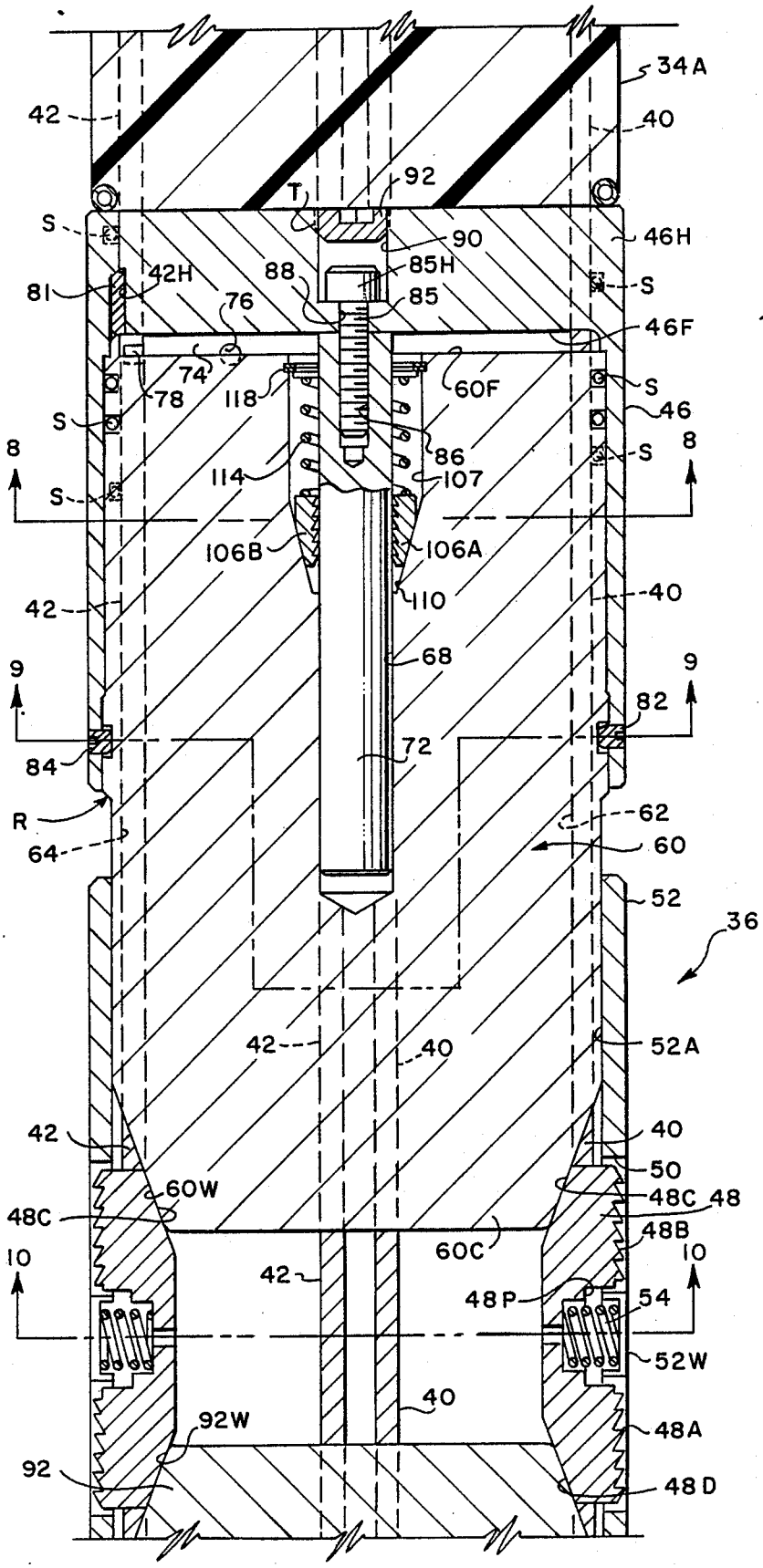
FIG. 11 is a simplified sectional view of the hydraulic actuator and locking assembly of the present invention; and, FIG. 12 is an exploded perspective view of the dual string hydraulic packer assembly of the present invention. .

Referring now to FIG. 2, FIG. 11 and FIG. 12, the hydraulic actuator assembly 38 includes the setting cylinder 46 and a piston 60. The setting cylinder 46 has a cylindrical bore 46A in which the piston 60 is received in slideable engagement. The external surface of the piston 60 is sealed against the inside diameter bore 46A of the setting cylinder by O-ring seals S. The piston 60 has first and second cylindrical bores 62, 64 through which the mandrels 40, 42 are extended in slideable, supporting relation. The piston 60 also includes first and second cylindrical pockets 66, 68 for receiving a pair of cylindrical locking rods 70, 72, respectively.

Referring again to FIG. 11, the piston 60 is received in telescoping engagement within the bore 46A of the setting cylinder 46. The piston 60 has an end face 60F which defines the lower boundary of a variable volume pressure chamber 74. The top boundary of the variable volume pressure chamber 74 is defined by an internal face 46F of the setting cylinder 46. Hydraulic fluid enters the pressure chamber 74 through one or more flow ports, with three flow ports 76, 78 and 80 being shown in the drawings. The flow ports are small radial bores which radially intersect the secondary mandrel 42. According to this arrangement, the secondary mandrel 42 is closed by a plug P, such as a drop ball which is dropped through the bore of the secondary mandrel 42. After mandrel 42 is closed, the mandrel bore 42 is pressurized with hydraulic fluid pumped through the secondary tubing string 32. Hydraulic fluid flows through the setting ports 76, 78, 80 into the hydraulic pressure chamber 74, thereby applying pressure against the piston face 60F and the setting cylinder face 46F.

In the run position as shown in FIG. 11, the setting cylinder 46 and piston 60 are releasably restrained against extension movement by threaded shear screws 82, 84. The shear screws 82, 84 are threaded into tapped bores formed in the setting cylinder, and project into blind bores formed in an annular setting plane shoulder H. According to this arrangement, the setting cylinder 46 is blocked from extension against the expandable packing seal elements 34, and the setting piston 60 together with the piston cone 60C, is likewise blocked against extension movement toward the anchor slips 48. Moreover, the primary and secondary mandrels are prevented from slipping relative to each other during the run mode by snap rings 79, 81. Snap ring 79 prevents an inadvertent set condition while running into the hole, should the lower wedge engage a collar or other tight bore structure. Snap ring 81 prevents an inadvertent set condition which might arise during a run-in operation in which it becomes necessary to temporarily retract the tubing strings through a tight collar or other tight bore area which would cause the setting cylinder 46 to be engaged and pushed downwardly. The snap ring 79 is set in an annular slot 42G formed in the external sidewall of the secondary mandrel 42, and the snap ring 81 is likewise received within an annular slot 42H. Thus, the setting piston 60 and the setting cylinder 46 are mechanically locked against extension movement which would tend to prematurely set the packing seal elements 34 and the anchor slips 48.

The locking rods 70, 72 are securely fastened to the setting cylinder face 46F by threaded bolt fasteners 83, 85, respectively. As shown in FIG. 11, the locking rod 72 has a threaded bore 86 in which the threaded bolt fastener 85 is threadedly secured. The threaded bolt fastener 85 is confined within a threaded bore 88 formed in the setting cylinder head 46H. The head 85H of the threaded bolt fastener 85 is received within a cylindrical counterbore 90 which is formed coaxially within the threaded bore 88. The counterbore 90 is threaded and is sealed by an NPT pressure plug 92. The threads of the NPT plug 92 are wrapped by a pressure resistant tape which effectively seals the counterbore 90 with respect to the hydraulic setting pressure.

The hydraulic actuator assembly 38 is mechanically coupled to the slip anchor assembly 36 by a top wedge spreader cone portion 60C of the piston 60. The piston 60 and spreader cone 60C extend downwardly within the slip carrier bore 52A. The piston spreader cone 60C has a downwardly sloping, frustoconical wedging surface 60W which is generally complementary to the upwardly sloping cam surface 48C of the anchor slip 48.

A lower spreader cone 92 is received within the slip carrier bore 52A below the anchor slips 48. The spreader cone 92 has an upwardly facing frustoconical wedging surface 92W which is generally complementary to a downwardly facing cam surface 48D formed on the anchor slip 48. The lower spreader cone 92 is connected to a bottom wedge 94. The bottom wedge 94 is releasably connected to a release sleeve 96 through a double detent collet coupling 98.

Axial compression forces transmitted through the anchor slip assembly onto the spreader cone 92 are reacted through the bottom wedge 94 and the release sleeve 96. The release sleeve 96 is releasably attached to the primary mandrel 40 by shear screws 100. The lower ends of the primary and secondary mandrels 40, 42 and the release sleeve 96 are stabilized and aligned by a lower retainer 102. The lower retainer 102 has first and second cylindrical bores 103, 105 through which the packer mandrels 40, 42 are extended, respectively.

As the piston 60 is driven downwardly in response to pressurization of the variable volume pressure chamber 74, reaction forces are transmitted through the anchor slips 4 onto the lower spreader cone 92 and bottom wedge 94. The compression forces are transmitted through the lower spreader cone 92, the bottom wedge 94 and release sleeve 96 through the double detent collet 98. The compression forces are reacted through the shear screws 100 which releasably secure the release sleeve 96 to the primary mandrel 40.

The lower retainer 102 is restrained against downward axial movement by the engagement of a radial shoulder 42S formed on the threaded box connector 42B of the secondary mandrel 42. In the run-in position as illustrated in FIGS. 2, 3A, 3B and 11, the bottom wedge 94 is fully retracted relative to the anchor slip assembly 36, and consequently, the anchor slips 48 are fully retracted within the windows 50 by the coiled compression springs 54. As the conical wedge surface 60W of the piston 60 is driven into engagement with the sloping wedge surface 48C, the anchor slips are displaced radially outwardly as the upper and lower spreader cones 60C, 92 engage and slip along the sloping cam surfaces 48C, 48D, respectively. As previously discussed, the lower spreader cone 92 and bottom wedge 94 are restrained against downward movement relative to the slip carrier 52 by the bottom wedge 94, release sleeve 96 and shear screws 100.

Referring again to FIG. 11, the cylindrical bores 62, 64 are sealed against the external cylindrical surfaces of the primary and secondary packer mandrels by O-ring seals S. The piston 60 is mounted for slideable, telescoping movement through the setting cylinder bore 46A. The interface between the piston 60 and the setting cylinder bore 46A is sealed by O-ring seals S. The axial space between the piston face 60F and the setting cylinder face 46F defines the variable volume pressure chamber 74 for directing hydraulic pressure against the piston head and the setting cylinder head. Hydraulic fluid pumped down the secondary tubing string 32 and into the packer mandrel 42 enters the variable volume pressure chamber 74 through the radial setting port 76, 78 and 80.

Figure 6:
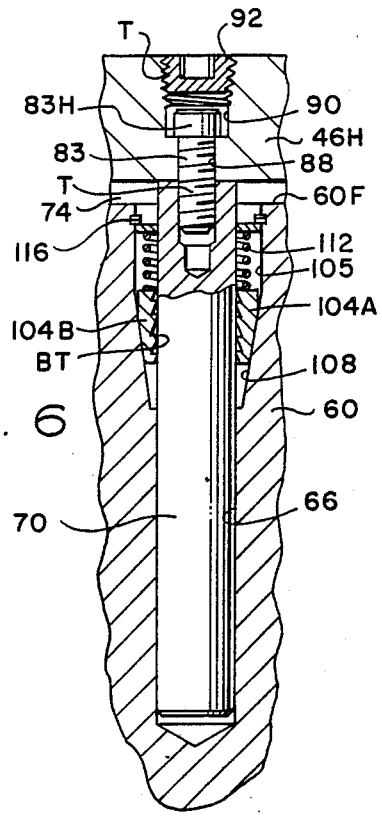
FIG. 6 is a sectional view of a locking rod in the run position taken along the lines 6—6 of FIG. 8.
Figure 7:
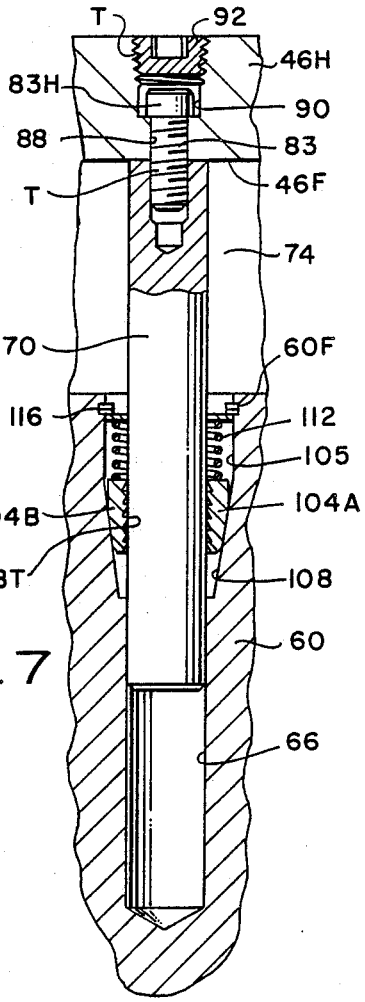
FIG. 7 is a sectional view of the locking rod in the extended, set position.
Figure 8:
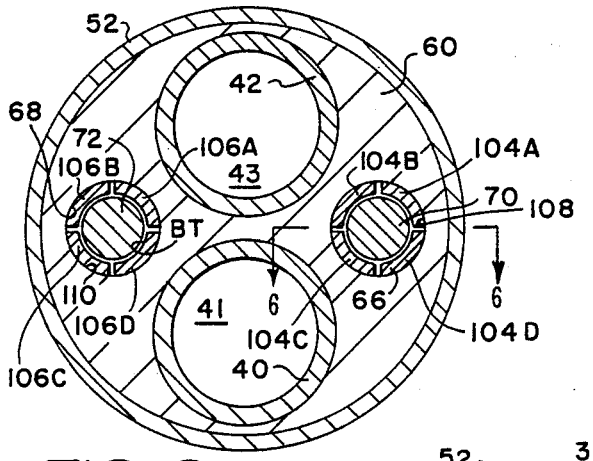
FIG. 8 is a sectional view of the piston and setting cylinder assembly taken along the lines 8—8 of FIG. 11.

Referring now to FIG. 6, FIG. 7, FIG. 8 and FIG. 11, the extended, set position of the piston 60 and setting cylinder 46 is secured by the unidirectional ratcheting action of a first set 104 of segmented, internal ratchet slips 104A, 104B, 104C and 104D which are interposed between the piston 60 and the locking rod 70, and by a second set 106 of segmented ratchet slips 106A, 106B, 106C and 106D which are interposed between the piston 60 and the locking rod 72. As seen in FIGS. 6, 7 and 8, the first and second sets of ratchet slips 104, 106 are received within slip pockets 105, 107 having tapered counterbores 108, 110, respectively. The tapered counterbores 108, 110 are concentrically formed with the locking rod pocket bores 66, 68, respectively. Each set of segmented locking ratchet slips is interposed between the sloping counterbore surface and the external cylindrical surface of the locking rods.

Each segmented locking slip has coarse, upwardly facing buttress threads BT which engage and bite into the external cylindrical surface of the locking rods, thereby permitting upward axial displacement of the locking rods relative to the piston 60, but preventing downward retraction of the locking rods. The inwardly facing buttress threads permit the locking rods 70, 72 to ratchet upwardly as the piston and setting cylinder are extended relative to each other, but downward retraction movement of the locking rods relative to the piston is prevented by the wedging action and biting engagement as the locking slip is urged along the sloping counterbore surface.

The segmented locking slips 104, 106 are biased for wedging movement along the sloping counterbore surfaces 108, 110 by coil springs 112, 114, respectively. The bias springs 112, 114 are confined within the slip pockets 105, 107 by retaining rings 116, 118, respectively. The bias spring impose a bias loading force of 50–70 pounds to insure that the segmented slips 104, 106 are retained within the conical counterbores 108, 110, respectively.

The locking action of the segmented ratchet slips 104, 106 against the locking rods 70, 72 prevents downward movement relative to the piston 60 since such retraction would cause the buttress threads BT to wedge the segmented slips 104, 106 even tighter into biting engagement against the locking rods. Consequently, once the setting cylinder 46 has been driven upwardly and fully extended into compressive engagement against the annular seal elements 34, the piston 60 is concurrently moved downwardly, driving the anchor slips 48 into set engagement against the well bore 12, and the set position is securely locked against retraction after the hydraulic driving pressure has been removed.

Figure 9:
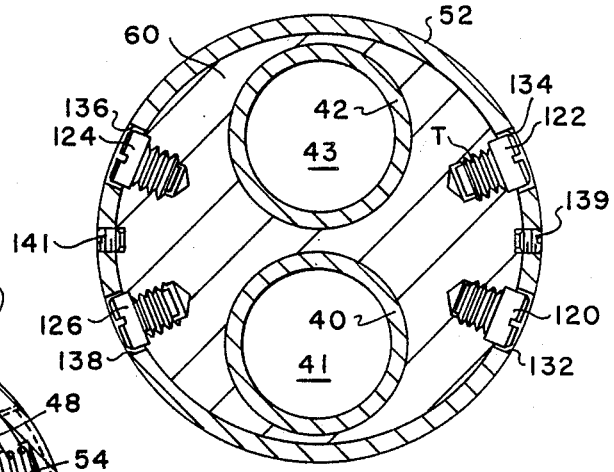
FIG. 9 is a sectional view of the piston assembly taken along the lines 9—9 of FIG. 11.
Figure 10:
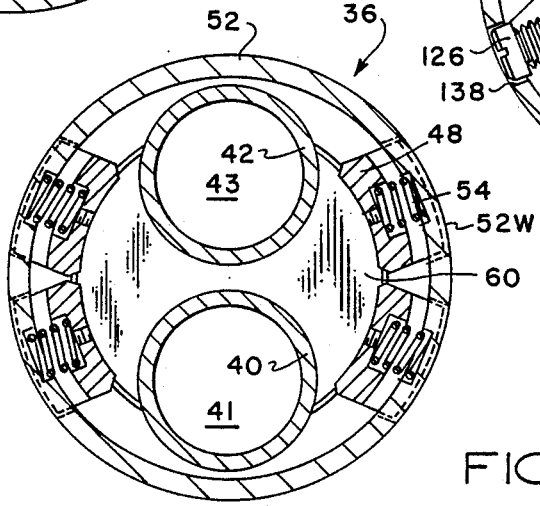
FIG. 10 is a sectional view of the mandrel and anchor slip assembly taken along the lines 10—10 of FIG. 11.

Referring now to FIG. 2 and FIG. 9, alignment of the slip housing 52 during extension and retraction is provided by piston guide lugs 120, 122, 124 and 126, and also by lower wedge guide lugs 128, 130. The piston guide lugs 120, 122, 124 and 126 are secured radially within the piston body by a threaded union T, and the head portions of each lug extend radially within axial slots 132, 134, 136 and 138, respectively, which are formed in the sidewall of the tubular slip carrier 52. Likewise, the lower wedge guide lugs 128, 130 project radially into axial slots 140, 142 formed in the lower end of the tubular slip carrier 36. The slip carrier 52 is releasably secured to the piston 60 by two or more shear screws 139, 141 which stabilize the slip carrier during run-in. The shear screws 139, 141 are rated for sequential release upon release of the piston 60. According to this arrangement, the slip housing 52 is maintained in coaxial alignment with the piston 60 and bottom spreader cone 92 during setting and release.

After the secondary packer mandrel 42 has been plugged, hydraulic fluid is pumped into the closed mandrel and is ported into the variable volume pressure chamber 74 and acts upon the head surface 60F of the piston and the setting cylinder head surface 46F. The setting cylinder 46 and piston 60 are initially locked together by the shear screws 82, 84. Upon application of hydraulic pressure into the variable volume pressure chamber 74, the pressure force is increased until the shear strength of the shear screws is overcome. As the shear screws 82, 84 separate, the setting cylinder 46 is released and is extended against the annular packing seal element 34A, and the shear screws 139, 141 separate as the piston 60 drives its conical wedge 60C into engagement with the anchor slips 48.

According to an important feature of the invention, the set condition is maintained and retraction of the piston relative to the setting cylinder is prevented by the locking rods 68, 70 which are trapped in compression between the head 46F of the setting cylinder and the segmented, internal ratchet slips 104, 106, respectively. The locking rods 68, 70 are compressed by the reaction forces imposed by the expandable seal elements 34A, 34B, 34C through the setting cylinder head 46H, and by the reaction forces transmitted through the anchor slips 48 and the piston 60.

Because the piston 60 and setting cylinder 46 are mounted for slideable, sealing engagement along the primary and secondary mandrels, and because the locking rods 68, 70 are secured by ratchet engagement with the segmented slips within pockets formed in the piston head, the primary and secondary mandrels 40, 42 are not subjected to radially directed setting forces which might cause collapse of the packer mandrels. Because the packer mandrels 40, 42 are not loaded radially, the primary and secondary mandrels can be provided with relatively large bores and relatively thin sidewalls. Moreover, because the set condition is locked internally by the ratchet slips and locking rods, auxiliary mandrels are not required.

Moreover, since the locking action is achieved internally within the piston head 60, the primary and secondary mandrels 40, 42 are not subjected to extra tension loading which might cause premature failure of the mandrel sidewalls. Because of the internal locking arrangement and the location of the hydraulic actuator piston 60 and setting cylinder 46 intermediate the expandable seal assembly 34 and slip assembly 36, substantially the entire surface area of the piston head 60F and substantially the entire setting cylinder head area 46F are available for transmitting the setting force developed within the variable volume hydraulic pressure chamber 74.

The presence of the two locking rods 68, 70 reduces the effective piston area and setting cylinder area only by about 3% for a 9⅝' dual packer assembly, assuming a locking rod diameter of 1¼'. Most importantly, the setting force is trapped by the segmented slips 104, 106 which trap the solid locking rods 68, 70 in compression to maintain the set condition. The solid locking rods, when maintained under compression, are less likely to fail downhole as compared with locking rods which are subjected to tension loading during the set mode of operation.

Referring now to FIG. 3A and FIG. 3B, the components of the dual string packer assembly 10 are shown in the run position. In the run position, the packer seal element assembly 34 is radially retracted, and the anchor slips 48 are radially retracted within the slip carrier 52. The piston 60 and the lower wedge 92 are at maximum separation. As seen in FIG. 6 and FIG. 11, the piston 60 is fully retracted within the setting cylinder bore 46A, and the variable volume pressure chamber 74 is at its minimum volume condition. The locking pistons 70, 72 are fully retracted within the cylindrical pockets 66, 68. The seal assembly 34 is unexpanded between the upper centralizer 44 and the setting cylinder head 46H. The hang weight of the lower tubing string 30 is transferred to the lower centralizer 102 by snap ring 144 which is engaged on its underside by an internal shoulder 102A of the lower retainer, and by an undercut shoulder 40A formed on the primary mandrel. The snap ring 144 couples the hang weight of the lower tubing string 30' through the lower retainer 102 and through the secondary packer mandrel 42 to the top element retainer 44. The force is then transmitted through the primary packer mandrel 40, thereby utilizing the hang weight to augment the setting force. The hang weight is not needed to achieve a set, but merely adds the hang weight of the bottom production tubing string 30' to the setting force. This has the effect of further reducing the level of hydraulic pressure required to complete the setting operation. The piston guide lugs 120, 122, 124 and 126 are fully extended within the slip carrier slots, and the lower wedge guide lugs 128, 130 are fully retracted within slip carrier slots 140, 142, respectively.

Referring now to FIG. 4A and FIG. 4B, the components of the dual string hydraulic packer 10 are shown in the fully extended, set position. In the set position, the packer seal elements 34A, 34B and 34C are compressed and expanded radially into engagement against the inside bore 12 of the well casing 14. The anchor slips 48 are extended radially against the bore of the well casing. At the onset of extension, the shear strength of the shear screws is overcome, with the result that each shear screw severs into two pieces, 82A, 82B and 84A, 84B, respectively, thereby permitting the piston 60 and setting cylinder 46 to extend relative to each other.

Concurrently with extension of the piston 60, the piston guide lugs 124, 126, 128 and 130 are partially retracted within the slip carrier slots 132, 134, 136 and 138, respectively. The lower wedge guide lug does not move at this time since downward movement of the lower guide wedge 92 is prevented by the bottom wedge and release sleeve which are releasably secured to the packer mandrel 40 by the shear screws 100.

Upon full extension of the anchor slips 48, the locking rods 68, 70 are fully extended out of the piston pockets 66, 68, respectively, thereby rigidly locking the piston 60 and setting cylinder 46 in their extended, set positions. The forces of compression transmitted through the setting cylinder and through the anchor slips are reacted by compression of the solid locking rods 70, 72. Retraction of the locking rods within the piston pockets 66, 68 is prevented by the unidirectional buttress threads BT formed on the segmented ratchet slips 104, 106.

After the seal elements 34 and anchor slips 48 have been set, hydraulic pressure is relieved and the plug P is removed, for example by wire line tool, or by pressurizing the secondary mandrel until the plug housing seat is fractured and the plug P is discharged into the annulus above the bottom packer 28. The well is then completed and ready for production.

Referring now to FIGS. 5A and 5B, the relative positions of the packer components are shown upon release and radial retraction of the packer seal assembly 34 and the anchor slip assembly 36 which is accomplished to permit retrieval of the packer 10 from the well bore. In this configuration, the packer 10 is released from the set configuration by a straight pull of the primary tubing string 30 relative to the secondary tubing string 32. Because the packer components are stacked on the primary and secondary packer mandrels 40, 42 in slideable engagement, the primary packer mandrel 40 can be retracted upwardly relative to the secondary packer mandrel 42 by an upward pull on the primary production tubing 30. A snap ring 146 is mounted about the secondary packer mandrel 42 within a counterbore pocket 44C formed concentrically with cylindrical mandrel passage bore 44B. Upward retraction of the secondary mandrel 42 is prevented by engagement of the snap ring 146 against the stepped shoulder between the counterbore 44C and the main mandrel passage bore 44B.

Axial retraction of the primary packer mandrel 40 relative to the secondary mandrel 42 is limited by the engagement of a snap ring 148 against an undercut profile shoulder 44P formed within the upper element retainer 44. Initially, as shown in FIG. 4A, the snap ring 148 is separated from the profile shoulder 44P by a distance of several inches. As the primary tubing string 30 is pulled upwardly, the packer mandrel 40 is retracted upwardly until the snap ring 148 engages the underside of the profile shoulder 44P. As the snap ring 148 engages the profile shoulder 44P, the set screws 100 are stressed until separation occurs, thereby permitting the packer mandrel 40 to be displaced upwardly with respect to the lower centralizer 102.

At the onset of release, the anchor slips 48 and the packer seals 34 are extended into locked engagement with the well casing bore. As the packer mandrel 40 is retracted, the snap ring 148 engages the profile shoulder 44P and displaces the upper seal element retainer 44 axially with respect to the packer seal assembly 34. This permits the packer seal elements 34 to retract radially and expand axially into the space formerly occupied by the element retainer 44.

Upon release of the double detent collet 98, the bottom wedge 94 can be displaced downwardly relative to the primary packer mandrel 40. The primary packer mandrel 40 is coupled to the piston 60 by a snap ring 150. Accordingly, as the primary mandrel 40 is displaced upwardly by the distance L as shown in FIG. 5A, the piston 60 is likewise displaced upwardly by the distance L, thereby releasing engagement with the slips 48. As the piston 60 moves upwardly, the piston guide lugs 120, 122, 124 and 126 engage the slip carrier 52 and carry it away from the lower spreader cone 92. Upon completion of retraction, the piston cone 60 and the spreader cone 92 are completely clear from the anchor slips. The anchor slips are then retracted radially inwardly by the compression springs 54, and release is thereby completed.

From the foregoing description, it will be appreciated that the dual string packer 10 can be set hydraulically and locked in sealing engagement against a well bore without imposing axial tension setting forces on the packer mandrels 40, 42. Moreover, the dual string hydraulic packer 10 is set and locked in sealing engagement against a well bore without subjecting the primary and secondary packer mandrels 40, 42 to radially directed compression setting forces which could pinch or otherwise collapse the mandrels. Setting is maintained without imposing continuous axial tension or radial compression of the packer mandrels by the hydraulic actuator and locking assembly 38 in which the piston 60 and setting cylinder 46 are extended between the packer seals and the anchor slips in response to the application of hydraulic pressure in the variable volume pressure chamber 74.

The set condition is maintained without imposing radially directed compression setting forces on the packer mandrels by the internal locking rods 72 and the segmented ratchet slip assemblies 104, 106. The locking rods 70, 72 are trapped in compression, and not in tension, after the seal elements have been engaged and the anchor slips have been set against the well bore.

Substantially all of the piston area 60F and the setting cylinder are 46F is utilized to develop the setting force, since the locking rods occupy a relatively small (3% total) of the force transmitting area. Because the force transmitting areas are large in comparison with comparable piston and setting cylinder components of prior art packers, the hydraulic pressure level required to achieve a positive set in sealing engagement in the dual string hydraulic packer 10 is substantially lower than that required in conventional packers. For example, in a 9⅝" diameter dual string hydraulic packer constructed according to the present invention, setting was initiated at 1,000 psi and was complete at 2,000 psi.

Since tension stress is not imposed on the mandrels after setting has been achieved, and because radial pinching forces are avoided by the improved hydraulic setting actuator and locking assembly 38, relatively large bore, thin walled packer mandrels can be safely used and the packer can be safely set and sealed without damaging the thin walled mandrels. Because the mandrel bore diameter is increased, production flow can be increased correspondingly. Since the hydraulic setting actuator and locking assembly 38 includes locking rods which are trapped in compression by internally mounted segmented ratchet slips, one piece primary and secondary packer mandrels can be utilized, and auxiliary mandrels are not required. Consequently, the packer seal elements are only required to seal about the primary and secondary mandrels, and not four longitudinal components as required by conventional dual string packers. Finally, because of the construction of the hydraulic setting actuator and locking assembly, the force developed by the hydraulic actuating piston and the setting cylinder is applied substantially equally to set the seal elements and anchor slips.

While a preferred embodiment of the invention has been set forth for purposes of disclosure, modification to the disclosed embodiment of the invention as well as other embodiments thereof may occur to those skilled in the art. Accordingly, the appended claims are intended to cover all embodiments of the invention and modifications to the disclosed embodiment which do not depart from the spirit and scope of the invention.

What is claimed is:

1. A hydraulic well packer comprising, in combination:

a tubular body mandrel having a longitudinal flow passage;

a seal element assembly movably mounted on said tubular body mandrel;

an anchor slip assembly supported by said tubular body mandrel;

a hydraulic actuator assembly movably mounted onto said tubular body mandrel, said hydraulic actuator assembly including first and second movable force transmitting means engagable with said seal element assembly and said anchor slip assembly, respectively;

said first movable force transmitting means having an axial slip pocket;

a locking rod slideably received within said slip pocket, said locking rod being connected to said second movable force transmitting means;

a ratchet slip assembly received within said slip pocket and engaging said locking rod, said ratchet slip assembly having teeth engaging the external surface of said locking rod and disposed relative to said locking rod for permitting extension of said locking rod out of said slip pocket, while preventing retraction of said locking rod into said slip pocket; and, wherein said first movable force transmitting means comprises a piston and wherein said second movable force transmitting means comprises a setting cylinder, said piston being slideably received in sealing engagement against the inside diameter bore of said setting cylinder, the head of said piston defining a first axial boundary of a variable volume pressure chamber, and said piston having a spreader cone for engaging said slip anchor assembly, said setting cylinder having a head portion disposed for engagement against said seal element assembly, and the inside face of said setting cylinder head defining a second axial boundary of the variable volume pressure chamber, said locking rod extending axially through said variable volume pressure chamber.

2. A hydraulic well packer as defined in claim 1, wherein said ratchet slip assembly comprises a plurality of segmented ratchet slips.

3. A hydraulic well packer as defined in claim 1, including a bias spring interposed between said first movable force transmitting means and said ratchet slip assembly for urging said ratchet slip assembly for retraction movement relative to said locking rod within said slip pocket.

4. A hydraulic well packer as defined in claim 1, said locking rod having a threaded axial bore, and including a threaded bolt fastener coupled to said second movable force transmitting means and secured in said threaded axial bore thereby connecting said locking rod to said second movable force transmitting means.

5. A hydraulic well packer as defined in claim 4, said second movable force transmitting means having a connecting bore through which said threaded bolt fastener is extended and having a counterbore pocket in which the head of said fastener bolt is received.

6. A hydraulic well packer as defined in claim 5, including a threaded pressure plug disposed in said counterbore pocket in sealed, threaded engagement with said second movable force transmitting means.

7. A hydraulic well packer as defined in claim 1, one of said force transmitting means having a spreader cone slideably mounted onto said packer mandrel and engagable with said slip actuator assembly, and the other one of said movable force transmitting means having a setting head engagable with said seal assembly.

8. A hydraulic well packer as defined in claim 1, said first and second movable force transmitting means comprising a piston mounted for slideable sealing engagement along said packer mandrel and a setting cylinder mounted for slideable, sealing engagement along said packer mandrel, respectively, said setting cylinder having a bore defining a pressure chamber in which said annular piston is received in slideable, sealing engagement, said packer mandrel having a flow port connecting the flow passage of said packer mandrel in flow communication with said pressure chamber.

9. A dual string hydraulic well packer comprising, in combination:

a primary packer mandrel having a longitudinal flow passage;

a secondary packer mandrel having a longitudinal flow passage;

an expandable seal element assembly mounted onto said primary and secondary packer mandrels;

an anchor slip assembly supported by said primary and secondary packer mandrels;

a hydraulic actuator assembly movably mounted onto said primary and secondary packer mandrels, said hydraulic actuator assembly including first and second movable force transmitting means engagable with said seal element assembly and said anchor slip assembly, respectively;

said first movable force transmitting means having first and second axial slip pockets;

first and second locking rods slideably received within said first and second slip pockets, respectively, said first and second locking rods being connected to said second movable force transmitting means;

first and second ratchet slip assemblies received within said first and second slip pockets, respectively, and engaging said first and second locking rods, respectively, said first and second ratchet slip assemblies having teeth engaging the external surfaces of said locking rods and disposed relative to said locking rods for permitting extension of said locking rods out of said slip pockets, while preventing retraction of said locking rods into said slip pockets; and, said first movable force transmitting means comprising a piston and wherein said second movable force transmitting means comprising a setting cylinder, said piston being slideably received in sealing engagement against the inside diameter bore of said setting cylinder, and said piston having first and second bores through which said first and second packer mandrels are extended, said setting cylinder having a head portion disposed for engagement against said seal element assembly and having first and second bores through which said primary and secondary packer mandrels are extended, said piston having a spreader cone for engaging said anchor slip assembly, the head of said piston defining a first axial boundary of the variable volume pressure chamber, and the inside face of said setting cylinder head defining a second axial boundary of the variable volume pressure chamber, said first and second locking rods extending axially through said variable volume pressure chamber.

10. A dual string hydraulic well packer as defined in claim 9, wherein each ratchet slip assembly comprises a plurality of segmented ratchet slips.

11. A dual string hydraulic well packer as defined in claim 9, said anchor slip assembly comprising a tubular slip carrier and a plurality of anchor slips mounted onto said slip carrier for radial shifting movement relative to said slip carrier, said tubular slip carrier having a plurality of axial slots for receiving guide lugs; and, a plurality of guide lugs mounted onto said second movable force transmitting means, said guide lugs extending through said axial slots in said slip carrier for stabilizing axial movement of said second movable force transmitting means relative to said slip carrier.

12. A dual string hydraulic well packer as defined in claim 9, said second movable force transmitting means comprising a piston having a spreader cone engagable with said anchor slip assembly, and including a bottom wedge movably mounted onto said primary and secondary packer mandrels, said bottom wedge having first and second cylindrical bores through which said first and second primary mandrels are extended, and having a spreader cone which is engagable with said anchor slip assembly;

a bottom retainer having first and second cylindrical bores through which said primary and secondary packer mandrels are extended;

a tubular release sleeve coupled to said primary packer mandrel and disposed intermediate said bottom retainer and said bottom wedge;

shearable connector means releasably securing said release sleeve to said primary packer mandrel; and, a releasable coupling collar interposed between said release sleeve and said bottom wedge for transmitting compression setting forces to said shearable mandrel connector means.

13. A dual string hydraulic packer assembly comprising, in combination:

a primary packer body mandrel having a longitudinal flow passage;

a secondary packer body mandrel having a longitudinal flow passage;

a top retainer having first and second cylindrical bores through which said primary and secondary packer mandrels are extended;

an expandable seal element having first and second cylindrical bores through which said primary and secondary packer mandrels are extended, said expandable seal element being engagable against said top retainer;

a setting cylinder having a head portion disposed for engagement against said seal element, said setting cylinder head having first and second bores through which said primary and secondary packer mandrels are extended, and said setting cylinder having an internal bore defining a pressure chamber for receiving a piston;

a piston having first and second cylindrical bores through which said primary and secondary packer mandrels are extended, and having first and second axial pockets for receiving locking rods, said piston being slideably received in sealing engagement against the inside bore of said setting cylinder, said piston having a spreader cone adapted for engagement with an anchor slip;

the head of said piston defining a first axial boundary of a variable volume pressure chamber, and the inside face of said setting cylinder head defining a second axial boundary of the variable volume pressure chamber;

first and second locking rods received within said variable volume pressure chamber, said first and second locking rods being attached to said setting cylinder head, and being received in telescoping engagement within said piston pockets;

first and second ratchet slip assemblies received within said piston pockets and engaging said first and second locking rods, respectively, said first and second ratchet slip assemblies each having teeth engaging the external surfaces of said locking rods for permitting extension movement of said locking rods relative to said piston, while preventing reversal of said extension movement;

a bottom retainer having first and second bores through which said primary and secondary packer mandrels are extended;

an anchor slip assembly disposed between said piston and said bottom retainer, said anchor slip assembly having a tubular slip carrier and a plurality of anchor slips mounted onto said tubular slip carrier for radial shifting movement, and having a plurality of axial slots for receiving guide lugs;

a plurality of guide lugs mounted onto said piston and received within the slip carrier axial slots;

a bottom wedge having first and second cylindrical bores through which said primary and secondary packer mandrels are extended, said bottom wedge having a lower spreader cone engagable with the anchor slips carried by the tubular slip carrier, a plurality of guide lugs mounted onto said bottom wedge and received within axial slots formed in said tubular slip carrier;

a tubular release sleeve mounted onto said primary packer mandrel and releasably connected thereto by shearable means, said release sleeve being releasably coupled to said bottom wedge; and, said secondary mandrel having a radial setting port in communication with said variable volume pressure chamber.

* * * * *